US006062772A

United States Patent [19]

Perkins

[11] Patent Number: 6,062,772

[45] **Date of Patent: *May 16, 2000**

[54] PLASTIC BLOCK RETAINING WALL WITH ATTACHED KEYLOCK FACING PANELS

[75] Inventor: Garry R. Perkins, Rolling Meadows, Ill.

[73] Assignee: G.P. Industries, Inc., Schaumburg, Ill.

[ * ] Notice: This patent is subject to a terminal disclaimer.

[21] Appl. No.: 09/086,791

[22] Filed: May 28, 1998

Related U.S. Application Data

[63] Continuation-in-part of application No. 08/524,202, Aug. 9, 1995, Pat. No. 5,788,423.

[51] Int. Cl.[7] ..... E02D 5/00; E02D 17/00; E02D 17/20

[52] U.S. Cl. ..... 405/284; 405/286; 52/604; 52/612

[58] Field of Search ..... 405/262, 284, 405/286; 52/311.1, 426, 570, 599, 604–606, 612

[56] References Cited

U.S. PATENT DOCUMENTS 5,214,898 6/1993 Beretta ..... 405/284 X
5,568,999 10/1996 Egan et al. ..... 405/262

*Primary Examiner*—Eileen Dunn Lillis
*Assistant Examiner*—Tara L. Mayo
*Attorney, Agent, or Firm*—Fitch, Even, Tabin & Flannery

[57] ABSTRACT

An inexpensive, yet beautiful retaining wall may be formed with architecturally pleasing, coordinating or matching materials such as marble, granite, stone, metal or the like. Architecturally pleasing, thin decorative facing panels are attached to plastic blocks which have hollow spaces to be filled with gravel or the like. The retaining wall is formed from several rows of such plastic blocks with the blocks in an upper row stacked upon the blocks in an adjacent lower row below the upper row and with the bottom edges of the upper row blocks being supported on adjacent lower row blocks. Decorative facing panels are provided which are substantially smaller in size than the plastic blocks and include a rear face attached to the front face of the plastic blocks to change the outward appearance of the front faces of the plastic blocks. Reinforcing ribs are formed in the walls of the hollow plastic blocks to add strength and rigidity while reducing the amount of plastic needed for the blocks. A keyway and key are formed in the front faces of the blocks and rear faces of the decorative facing panels for securing the decorative facing panels flush against the front faces of the blocks and an adhesive may also be used to attach the facing panels to the blocks. To hold the blocks against shifting laterally, depending tabs on the upper blocks in the retaining wall are inserted into receiving spaces in the underlying blocks on the wall.

16 Claims, 10 Drawing Sheets

FIG. 3
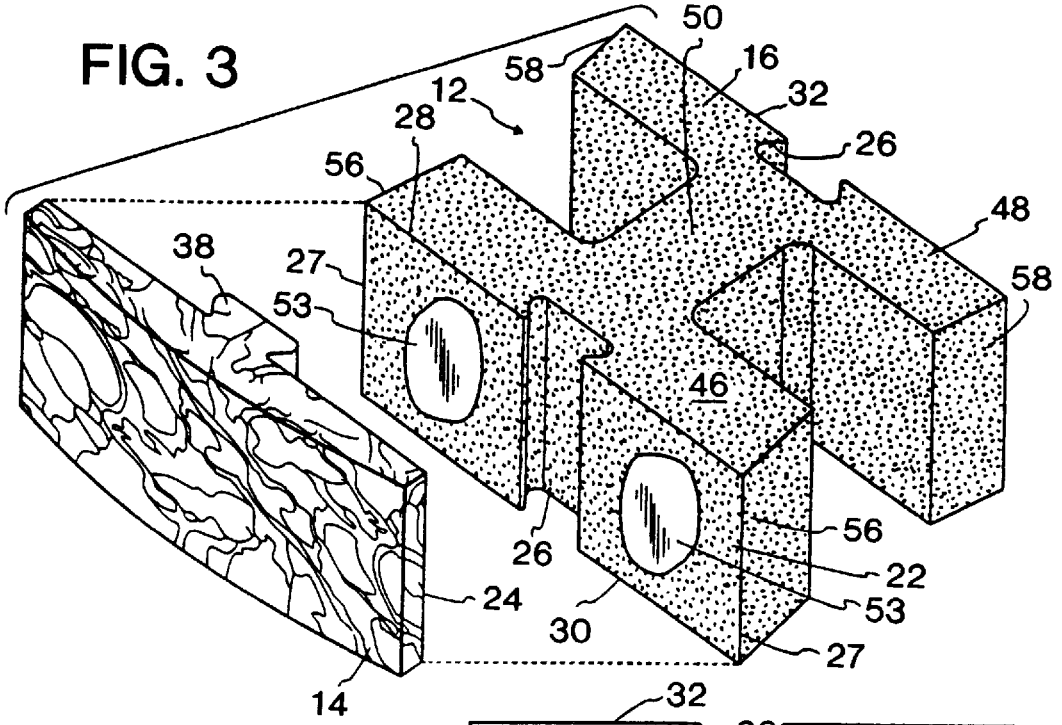
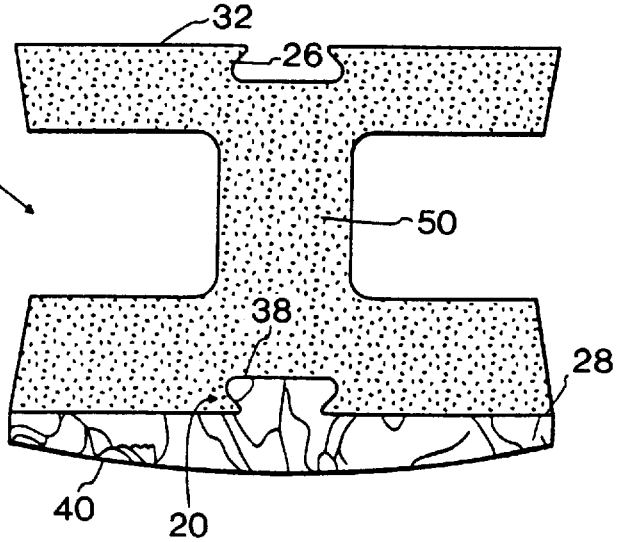
FIG. 4
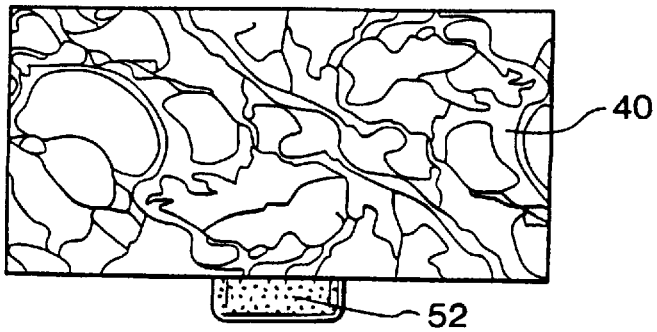
FIG. 5

FIG. 16
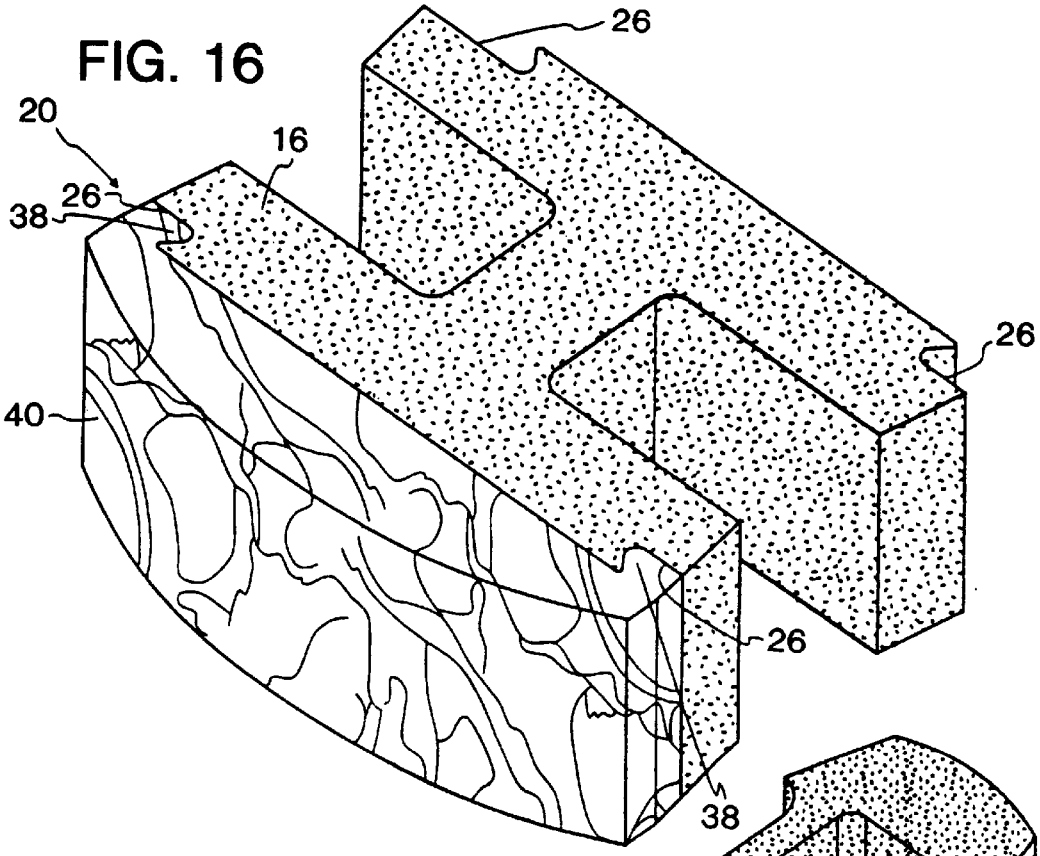
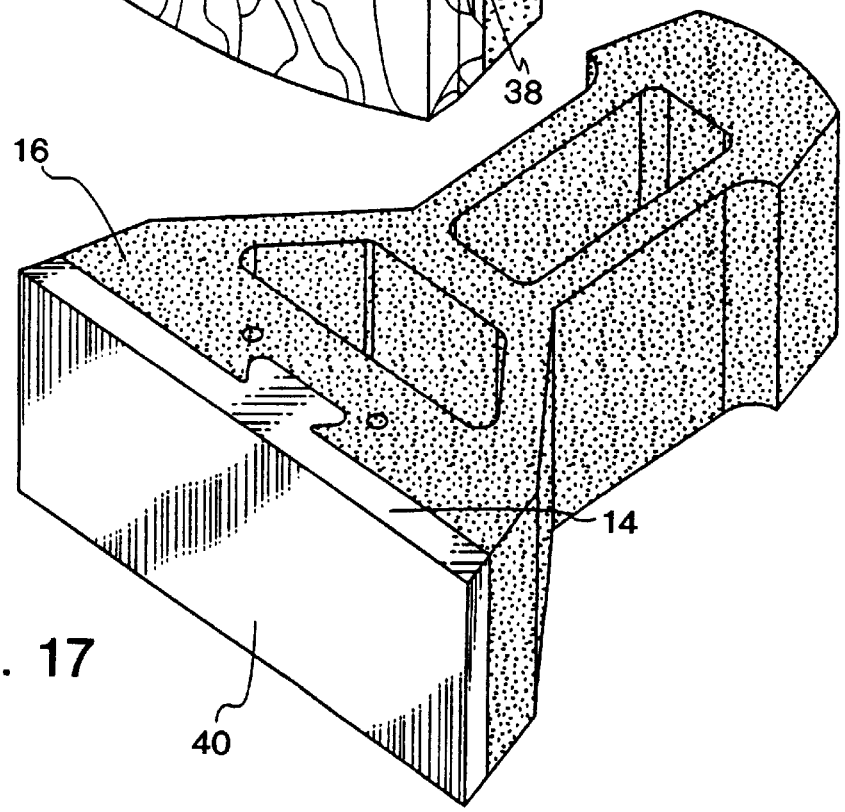
FIG. 17

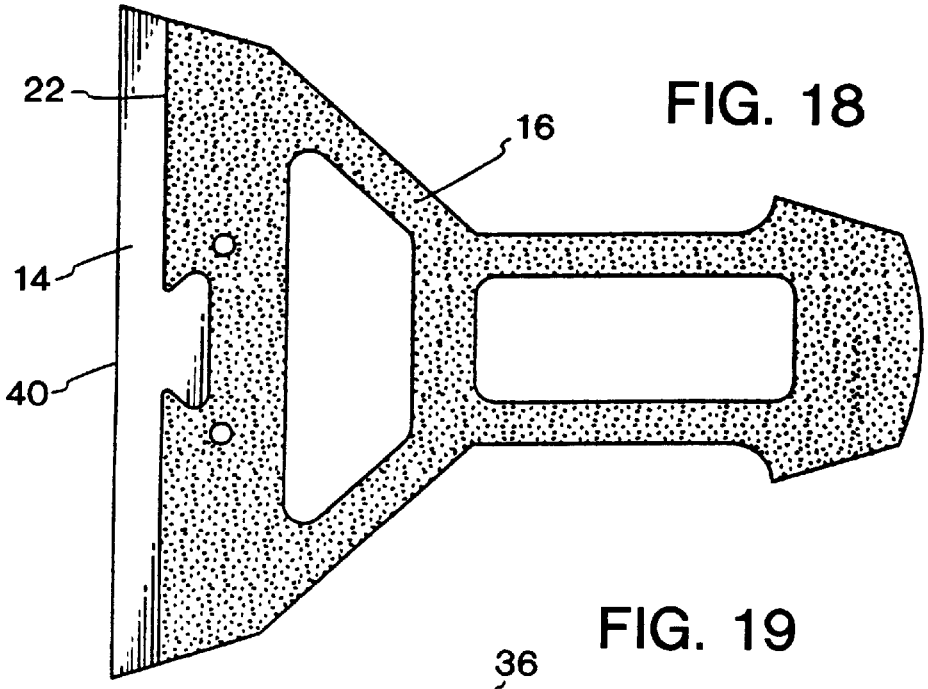
FIG. 18
FIG. 19
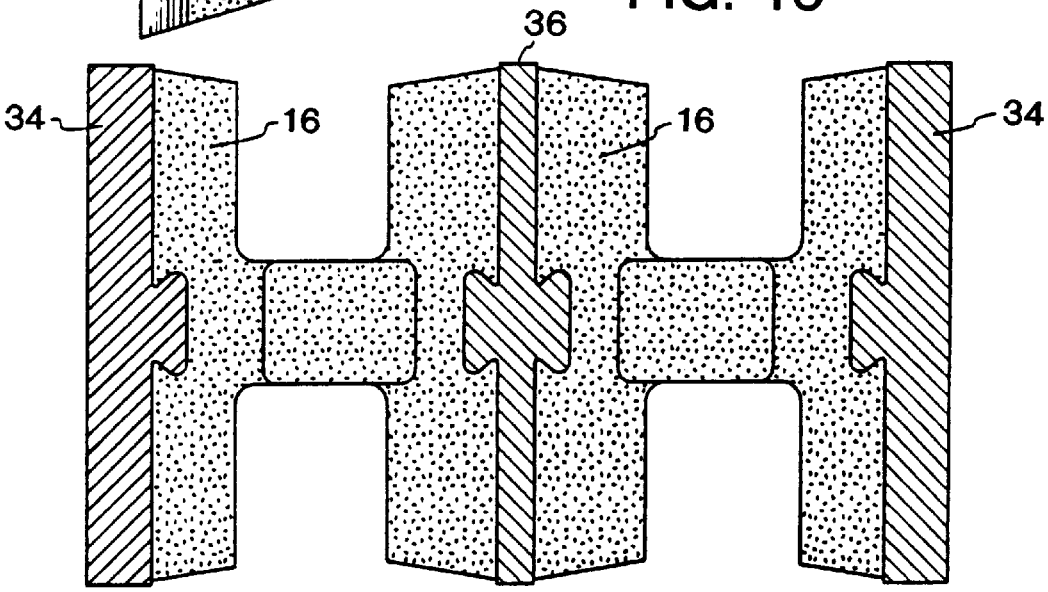
FIG. 20
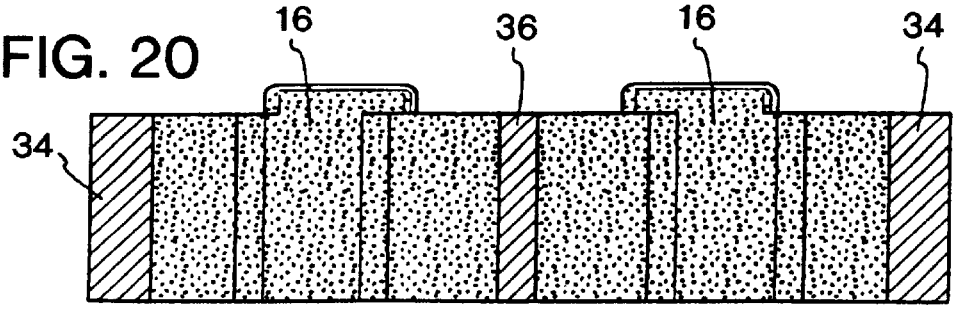

PLASTIC BLOCK RETAINING WALL WITH ATTACHED KEYLOCK FACING PANELS

This is a continuation-in-part of prior application Ser. No. 08/524,202, filed Aug. 9, 1995, now U.S. Pat. No. 5,788,423 which is hereby incorporated herein by reference in its entirety.

FIELD OF THE INVENTION

The present invention relates to retaining walls and, more particularly, to retaining walls made from masonry blocks having facing panels attached thereto.

BACKGROUND OF THE INVENTION

There are a wide variety of exterior beautiful wall materials such as marble, granite, black or colored glass, tile, polished metal, stainless steel, copper or gold colored metal sheets, anodized metals, etc. which cover the outer sides of buildings. These building facing materials are generally quite expensive and usually in the shape of flat sheets which are relatively thin in cross-section. Often beautiful terrazzo or fancy tile walkways surround or lead to such buildings and are of a matching material or are color coordinated to tie them architecturally to the building. Elaborate landscape plantings are often combined with and enhance the beauty of the structure and its setting. Generally though, any retaining walls or waterway walls around such buildings are made of masonry or concrete materials, probably because the blocks are so heavy and deep in cross-section that it would be prohibitively expensive to make the retaining walls of a matching material, e.g., a marble or stainless material retaining block. Typically, the retaining wall block is quite thick and deep in the shape of a large block; whereas, the typical architectural building wall facing panel is a large, thin flat sheet. Thus, to form an architectural wall of large thick blocks of marble, stainless steel, etc. is too expensive and is not done, except maybe in a rare instance. The heavy block weight and large block depth are needed to provide a stable stack of blocks one upon another to build a high self-supporting wall which also is used to retain soil behind it. Thus, there is a need for a less expensive architectural matching retaining wall that can match the beauty of building and walkways about the building.

Masonry blocks for retaining walls typically are cast in metal molds to form a unitary block body with the mold defining the shape of the masonry block body. The retaining walls may be formed by lining the blocks in a row on compacted road mix spread on soil therebelow. The wall is built to its desired height by simply stacking rows of blocks on the row immediately therebelow. When used to retain soil, the wall can be spaced forwardly from the soil to be retained with the space between the wall and soil filled by a volume of open-grade clear stone. In this manner, the retaining wall is not in contact with the soil it retains and, as such, is not subject to damage, e.g., water damage, which such contact can cause. To provide for run-off to avoid damaging the base of the wall, a drain tile can be provided near the bottom of the stone.

A retaining wall which is erected as described above has an outward appearance defined by the forward, outwardly-facing sides of the blocks, and as such, usually has a masonry appearance as the block face is formed from the same material as the body of the blocks. While it is possible to change the outward form of the retaining wall, for example, by altering the mold shape in which the masonry blocks are formed, the wall is restricted in its appearance by the material with which the blocks are formed. Another known manner for changing the outward form of blocks involves simultaneously forming a pair of mirror-image blocks in a single mold so that they are joined in the mold. After forming the pair of blocks in the mold, the attached pair of blocks are then split in half at their joined faces to expose the previously attached faces such that a roughened surface appearance is produced. However, it is desirable for retaining walls to be able to provide an outward appearance that is different from the appearance of the low cost material by which the block body is generally formed, usually to the appearance provided by a more expensive material, such as marble, without incurring the higher costs associated with making the entire block body from these more expensive materials. In this manner, the outward appearance of retaining walls can be economically matched to the materials from which surrounding structures are built, such as buildings and homes. It is also desirable to provide retaining walls which can have their appearance quickly and easily changed in the field in case of damage or changes in desired appearance.

In the aforesaid patent application, an architectural retaining wall made of masonry blocks with a decorative face of marble, granite, colored glass, metal or the like is produced inexpensively so that it can be used to match, coordinate or otherwise compliment a building or walkway material. More specifically, beautiful retaining walls are formed from a plurality of rows of masonry blocks having thin, decorative, architectural facing panels substantially smaller in size than masonry blocks are attached to the masonry or concrete blocks to change the outward appearance of the front faces of the masonry blocks to conform to the architect's overall use of similar or matching colors and/or materials. A locking system is provided which allows the decorative facing panels to be securely attached to the block bodies in a quick and easy manner in the field. This locking system holds the facing panels securely against thawing, freezing, changes in temperature and shifting of blocks.

As disclosed in the aforesaid patent application, these decorative retaining wall blocks of masonry material provide a great deal of flexibility in design with the ability to match retaining walls made thereof to a wide variety of building exteriors at a very low cost as compared to having to make the full retaining wall block of the exterior building material, such as expensive marble, granite, aluminum or bronze.

The masonry retaining walls of the aforesaid patent application are quite heavy, and shipping costs are quite prohibitive for transporting over long distances. Also, the cost of the retaining wall, masonry blocks is quite high even without the facing panels attached thereto. The installation of such heavy masonry blocks is also a deterrent to their usage by homeowners or other non-professionals who want to transport the blocks in their family vehicle and who must lift and carry the blocks to their final installation positions in the retaining wall.

SUMMARY OF THE INVENTION

In accordance with the present invention, an architectural garden kind of retaining wall with a decorative face of stone, marble, granite, colored glass, metal or the like is made with plastic, retaining wall blocks with attached, architectural facing panels. This is achieved by molding retaining wall blocks of plastic material, rather than heavy masonry material, and attaching decorative facing panels to the lightweight, plastic, retaining wall blocks. It is preferred that the plastic, retaining wall blocks have the general shape of the masonry blocks and that they have hollow spaces within the masonry blocks which are filled with gravel to add weight and stability to the wall. Preferably, when the grading around the plastic retaining wall with attached facing panels is completed, a person will be unable to distinguish it from the masonry retaining wall.

In accordance with an important aspect of the invention, the preferred plastic blocks have their walls defining these hollow spaces formed with reinforcing, integral ribs to provide additional strength and rigidity to the blocks. The preferred, plastic retaining walls have thinner wall cross-sections than the same-shaped masonry blocks disclosed in the aforesaid patent application; and the ribs provide additional strength and stiffening to these thinner walls and larger interior, hollow spaces will hold more of the heavy gravel to keep the plastic blocks in place. Thus, less plastic may be used because of the use of these ribs to obtain the strength of heavier plastic walls.

Preferably, the locking system, which includes a keyway formed in the front faces of the plastic blocks, and a key formed on the rear faces of the decorative facing panels such that a decorative facing panel can be slidably mounted onto each of the plastic block bodies. This key system will help hold the blocks which have a relatively low, coefficient of friction and tend to slide relative to one another. To build retaining walls with the decorative blocks, the plastic blocks are stacked such that the lower edge of an upper block rests on an adjacent lower row block to produce a set back from one row of blocks to the next. In this manner, the decorative facing panels will be attached to an upper block by sliding its key into a keyway of an upper block body so that the facing panel will rest on and be supported by block units in a lower offset row each including a similarly attached block body and facing panel with the upper facing panel being prevented from sliding downwardly as it rests on the row of blocks immediately therebelow. To further secure the decorative facing panels to the blocks, the locking system therebetween may include an adhesive which can be applied between the blocks and facing panels which when cured bonds the facing to the plastic, retaining wall block.

Where the retaining wall block is fairly long, such as 36' wide rather than the normal 16' wide block, the blocks can be provided with multiple keyways for receipt of corresponding keys on decorative facing panels. Further, the blocks can have a keyway formed in their back face for mounting facing panels flush against the back faces of the blocks such as may be desirable for designing retaining walls for buildings, homes and the like where both sides of the wall may be visible.

In one form, the blocks can include tabs protruding from the bottom thereof and with the blocks being configured to form openings between adjacent blocks in a row. With the tabs of upper blocks inserted into the openings between adjacent lower blocks, the tabs and openings cooperate to substantially fix the stacked blocks and adjacent upper lower rows in offset relation to each other. In this manner, a wall can be formed having a uniform set back from one row to the next. Further, this assists in ensuring that the decorative facing panels rest on blocks immediately therebelow so as not to slide downwardly out of the keylock arrangement with its corresponding block body.

Preferably, the keys or locating members on the decorative facing panels and the keyways on the blocks have complementary cross-sectional shapes, such as a trapezoidal shape, to mount the facing panels flush against their corresponding block bodies with the locating members matingly inserted in the keyways. Manifestly, the shape of the complementary keyway and key can be varied while still falling within the purview of the present invention.

In another form, more than one decorative facing panel can be attached to one block body to produce a different decorative design, and with different types of panels, various combinations of designs and/or colors.

As previously mentioned, the block bodies can be made from a low-cost, plastic material with appropriate filler materials therein; while the smaller, decorative facing panels can be made from more expensive materials such as a marble or granite, or a metallic material such as copper or aluminum. With the smaller decorative facing panels, the panels can be economically made from more expensive materials to provide an appearance desired for a landscaping retaining wall or to provide the same material needed to match the material of a commercial or industrial or even residential buildings.

Also, it will be apparent that the decorative facing panels can be attached to a wide variety of differently-shaped, plastic block bodies with the facing panels and block bodies provided with the aforesaid keyway interlock.

In a preferred embodiment, the plastic block body can have an H-shape in cross-section defined by a pair of elongate spaced legs spanned by an intermediate web with the forward block face and keyway interlock formed on at least one of the spaced legs. When forming the retaining wall, the blocks in a row are placed in abutting relation to one another by aligning the ends of their legs against each other such that the leg including the block face and keyway interlock is facing forwardly. With the blocks so arranged, adjacent blocks will form an opening defined by portions of their abutting legs and by their webs which can receive a tab formed on the bottom of the web and protruding forwardly underneath the forward leg such that with the blocks stacked in rows the tabs will uniformly set back the blocks in one row from the row therebelow. Thereafter, the facing panels can be slidingly mounted in the keyways so that their rear faces are flush against the front faces of the blocks with the panels being supported by the blocks therebelow.

BRIEF DESCRIPTION OF THE DRAWINGS

FIG. 3 is a perspective view of a single block and decorative facing panel utilized in the wall of FIG. 1;

FIG. 4 is a plan view of the block and facing panel of FIG. 3;

FIG. 5 is a front elevational view of the block of FIG. 3 showing a tab projecting from the bottom of the block;

FIG. 16 is a perspective view of a fifth alternative embodiment of the decorative facing panel with a block body as illustrated in FIG. 3 adapted to be attached to the decorative facing panel;

FIG. 17 is a facing panel similar to that illustrated in FIGS. 1–8 used with an alternative block body;

FIG. 18 is a plan view of the panel and block body of FIG. 17;

FIG. 19 is a plan view of a pair of block bodies as formed in the mold having metal mold inserts;

FIG. 20 is an elevational view of the pair of block bodies of FIG. 19;

DETAILED DESCRIPTION OF THE PREFERRED EMBODIMENTS

Figure 1:
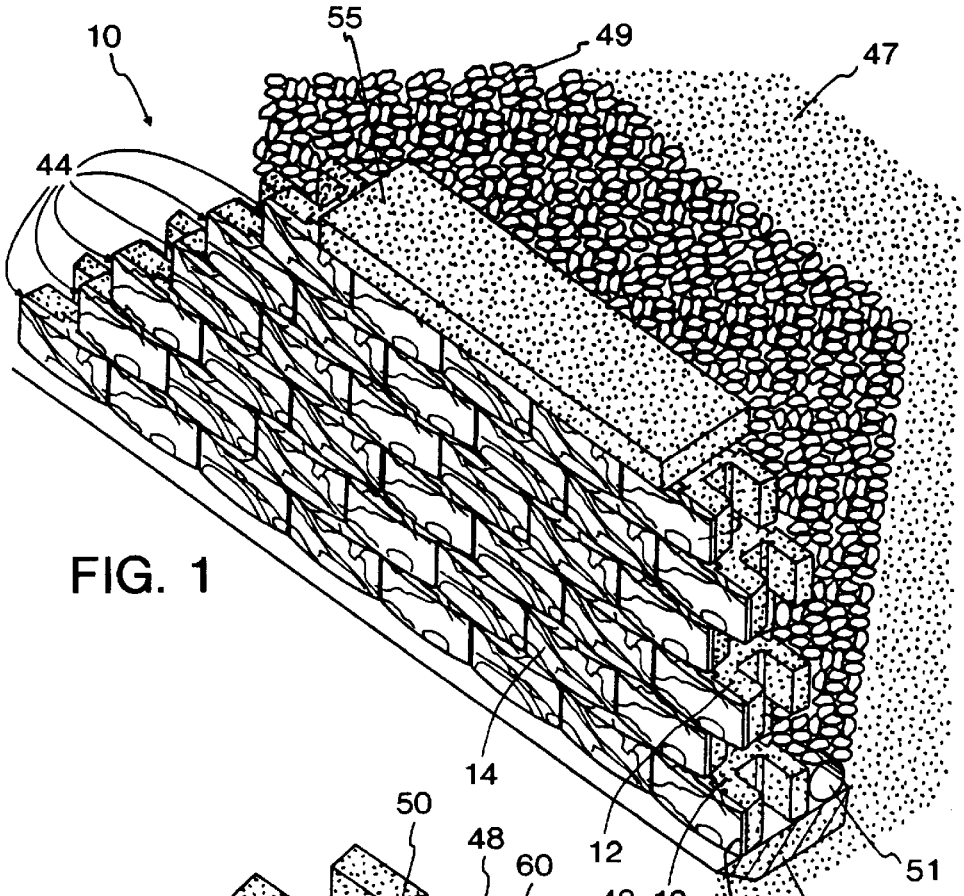
FIG. 1 is a perspective view of a retaining wall formed by rows of blocks having decorative facing panels attached thereto.

In FIG. 1, a retaining wall 10 is illustrated which is constructed from the masonry blocks 12 and decorative facing panels 14 of the present invention. As can be seen in FIG. 1, the decorative facing panels 14 provide the retaining wall 10 with an outward appearance that is different from the appearance of the masonry blocks 12 without the facing panels 14. In this manner, large block bodies 16 can be cast or molded from a low cost masonry or concrete material while using more expensive materials, such as marble or granite or even metallic materials, such as copper or aluminum, for the smaller decorative facing panels 14. This is of particular value to retaining wall designers such as engineers and landscape architects as attractive retaining walls can be economically built which match commercial, industrial or even residential buildings. This provides virtually unlimited flexibility in design in that the designers have the ability to match retaining walls to almost any building exterior at a relatively low cost as opposed to having to make the full retaining wall blocks of the more expensive decorative facing panel material. Further, the blocks 12 and facing panels 14 of the present invention allow engineers designing and building large highway retaining walls and waterway walls and the like to form such walls with a more aesthetically pleasing outward appearance than was previously economical.

To attach the decorative facing panel 14 to the block body 16 to form block units 18 for use in decorative retaining walls 10, interengaging female and male structure for removably attaching the facing panels 14 to the block body 16 is provided in the form of a keyway interlock system 20. Referring to FIG. 3, the block body 16 includes a front face 22 and the facing panel 14 includes a rear face 24 with the keyway interlock system 20 including a first portion on the front face 22 of the block body 16 and a second portion of the keyway interlock system 20 on the rear face 24 of the decorative facing panels 14. More specifically, the block bodies 16 each include an elongate keyway 26 formed in the block body front face 22 intermediate of its outer side edges 27. The keyway 26 extends vertically from a top edge 28 to a bottom edge 30 of the block body front face 22. Typically, a block body 16 will be approximately 16' wide as measured across its front face 22 between side edges 27. However, the block body 16 can be wider, such as for example 36', wherein multiple keyways 26 may be desirable for attaching facing panels 14 thereto. In this instance, the keyways 26 can be formed at the outer edges of the front face 22, as is illustrated in FIG. 16. Typically, retaining wall blocks weigh 60 to 80 lbs. or more and have a depth of twelve inches or more and a height of eight inches or more.

In the illustrated and preferred form, the elongate keyway 26 has a trapezoidal shape in cross-section with its corners rounded off. In the form shown in FIG. 16, the keyways 26 are of a half-trapezoidal shape with the keyways opening to the sides of the block bodies 16. It is also possible to provide the rear faces 32 of the block bodies 16 with similar elongate keyways 26 where the retaining wall 10 is to be visible from either side thereof, such as when used with commercial or residential buildings.

The elongate keyways 26 can be easily cast into the block bodies 16 as the block bodies 16 are formed in metal molds. One method for forming block bodies 16 as described in the Background utilizes molds which are designed to form a pair of attached block bodies 16 in a single mold which are then split to form two separate masonry blocks 12. Referring to FIGS. 19 and 20, to form keyways 26 in such a mold, metal mold inserts 34 can be inserted at either end of the mold to form the opposing rear faces 32 with such keyways 26 in a pair of block bodies 16 formed in the mold. To form the keyways 26 in the front faces 22 of the block bodies 16, a central metal mold insert 36 can be used between confronting front faces 22 of a pair of block bodies 16 formed simultaneously in one mold. In this manner, the block bodies 16 are not attached when formed in the mold as described above. As one skilled in the art will appreciate, a wide variety of other methods and molding systems can be used to form the block bodies 16.

To attach the decorative facing panels 14 to the block bodies 16 formed with the keyways 26 described herein, the facing panels are formed with a cooperating elongate locating member or tongue-key 38 which is sized to closely fit into the keyways 26 of the block bodies 16 so that when the keys 38 are slid into the keyways 26, the rear face 24 of the decorative panels 14 are flush against the front face 22 of the block bodies 16. To ensure a tight fit, the keys 38 have a cross-sectional shape that is complementary to the cross-sectional shape of the keyways 26 which can be a trapezoidal or half-trapezoidal shape, as previously described and illustrated in the Figures. Manifestly, a wide variety of other shapes can also be used such as round or hexagonal-shaped keys and keyways (not shown).

Figure 21:
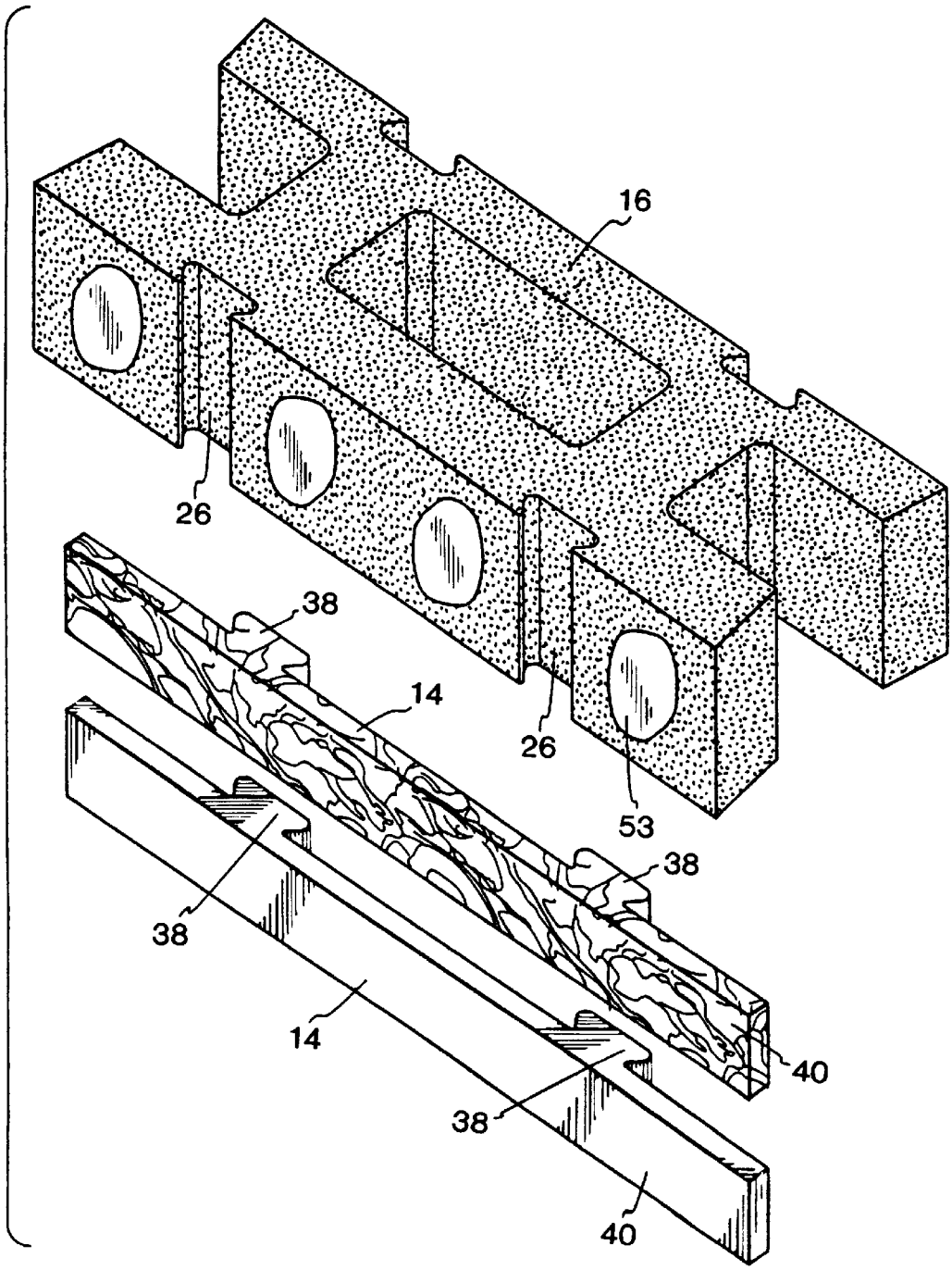
FIG. 21 is a perspective view of the block of FIG. 3 and a pair of facing panels for attachment thereto.

The keys 38 as described above can be extruded from a metal or plastic material and then bonded to the rear face 24 of the decorative facing panels 14. Preferably, the keys 38 are cast or ground into the decorative facing panels 14 so as to be integral therewith, depending upon the material from which the facing panel is formed. As previously described, the facing panels can be formed from a wide variety of different materials so as to give the masonry blocks 12 a different outward appearance. So, for example, the facing panels 14 can be formed from more expensive marble, granite or metallic materials such as aluminum or bronze versus the lower cost masonry or concrete material used to make the block bodies 16. Other materials which can be used include plastics, glass, brick, tile and composites. A designer has a virtually unlimited selection of materials from which to choose for the decorative facing panels 14 so as to enhance the aesthetics of the masonry blocks 12 and/or to match a building exterior at a lower cost versus making the entire block 12 from the desired material used with the facing panel 14. It is also possible to use multiple facing panels 14 with a single block body 16, as illustrated in FIG. 21. In this manner, a combination of designs can be achieved on a single block body 16.

Figure 13:
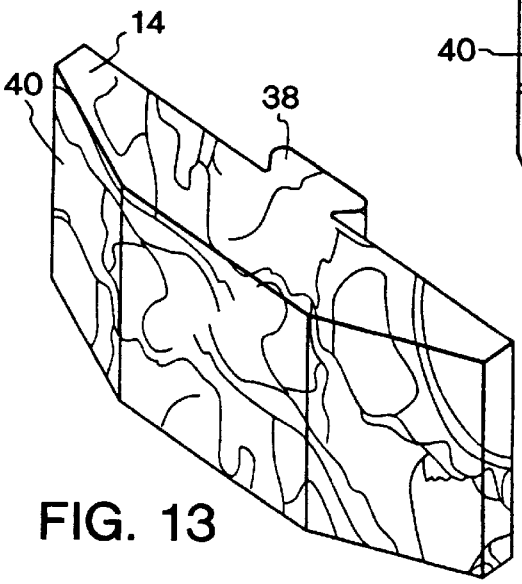
FIG. 13 is a second alternative embodiment of the decorative facing panel according to the present invention.
Figure 14:
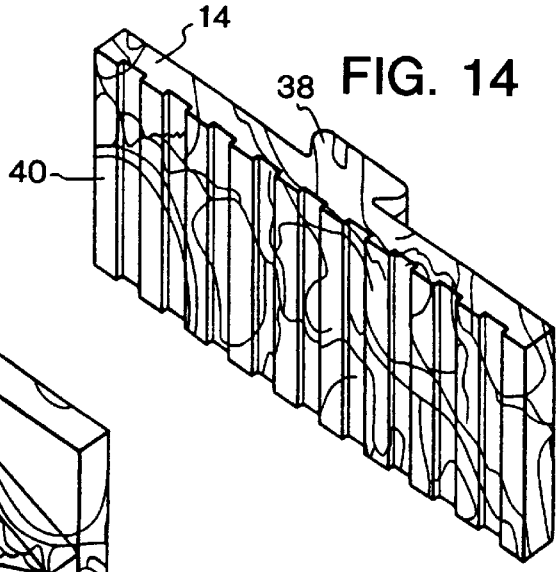
FIG. 14 is a third alternative embodiment of the decorative facing panel according to the present invention.
Figure 15:
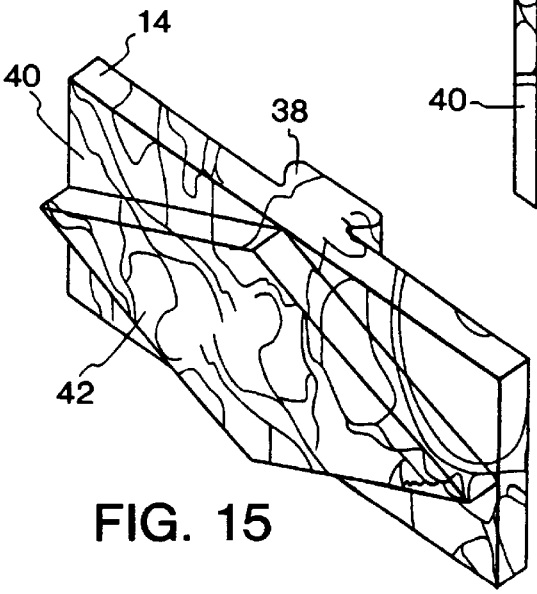
FIG. 15 is a fourth alternative embodiment of the decorative facing panel according to the present invention.

The facing panels 14 themselves can take on a wide variety of shapes and forms which can be used with a single type and shape of block body 16 having a keyway 24. This obviates the need to provide different molds for making block bodies of different shapes, thereby providing further flexibility of design without increasing the expense in the manufacture of the block bodies 16. The facing panels 14 as depicted in FIGS. 1–12 have a slightly curved front face 40. FIGS. 13–15 and FIG. 17 illustrate some of the other possible variations on the form of the front face 40. FIG. 13 shows an angled front face 40; FIG. 14 shows a fluted front face 40; FIG. 15 shows a front face 40 with a diamond-shaped raised portion 42; and FIG. 17 shows a flat face.

With the block units 18 formed from decorative facing panels 14 attached to masonry blocks 12 using the keyway interlock system 20 as described above, it is apparent that a wide variety of aesthetically appealing retaining walls 10 can be formed for lower costs than previously possible. A designer need not have the blocks which make up the retaining walls manufactured from the more expensive facing panel material and instead can utilize the smaller facing panels 14 with the blocks 12 made from the lower-cost masonry or concrete material, as described herein.

Figure 2:
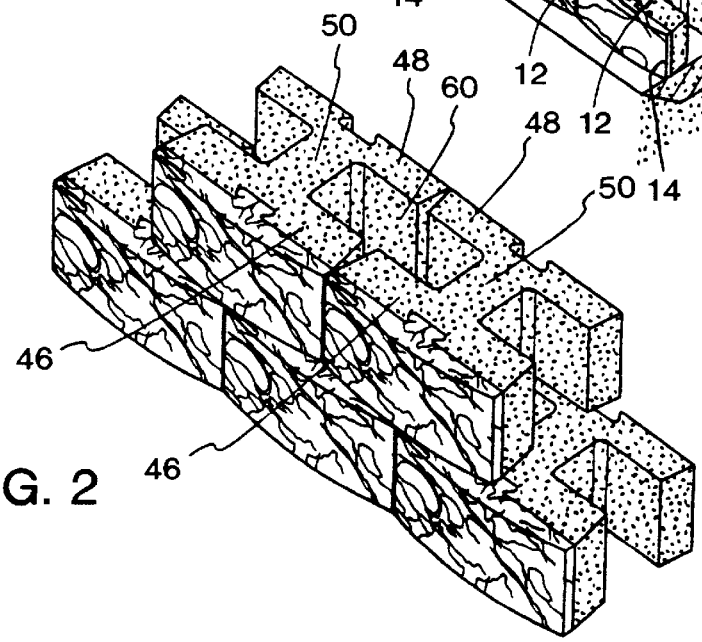
FIG. 2 is an enlarged perspective view of a portion of the wall of FIG. 1.
Figure 6:
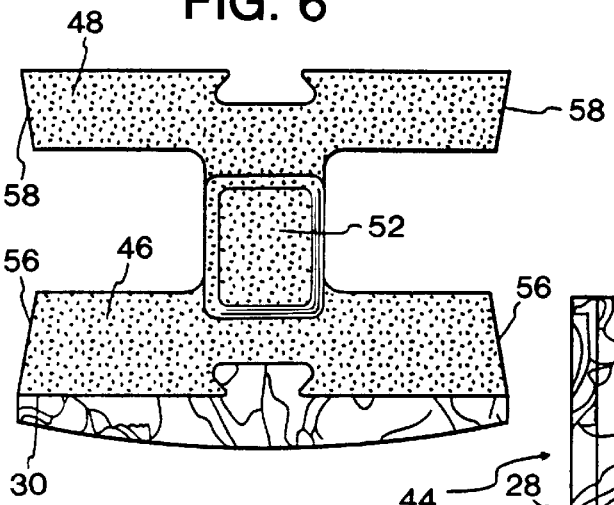
FIG. 6 is a bottom-plan view of the block and decorative panel of FIG. 3.
Figure 7:
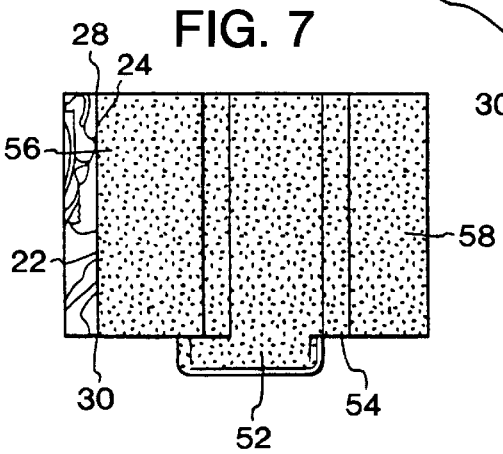
FIG. 7 is a side elevational view of the block and panel of FIG. 3.
Figure 8:
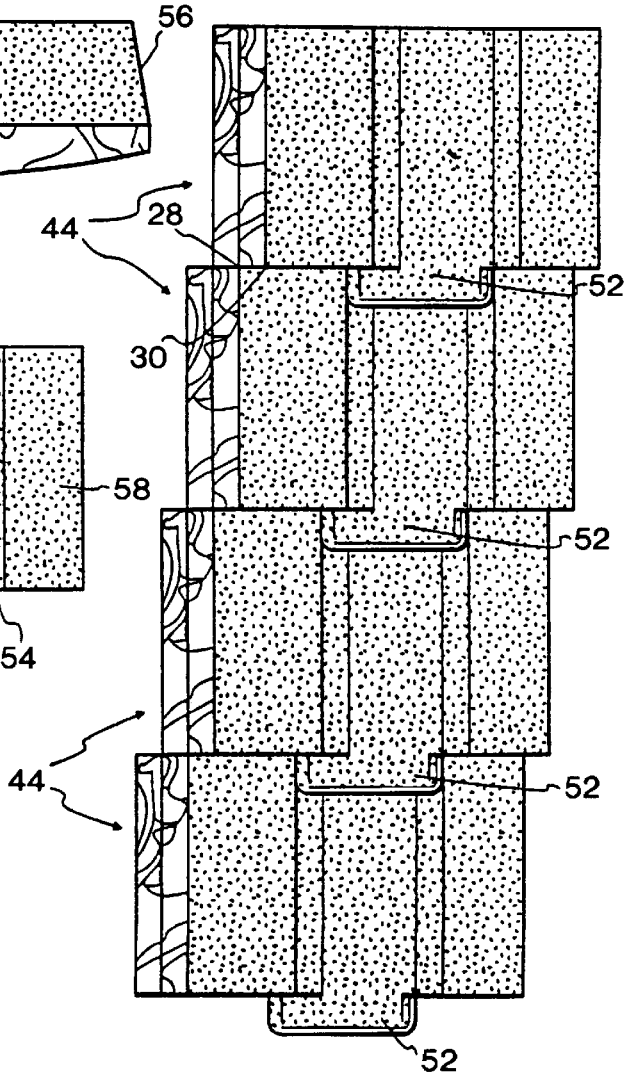
FIG. 8 is an enlarged side elevational view of a portion of the wall of FIG. 1 showing the set back relation of successive rows of blocks and panels.

By virtue of the blocks 12 and facing panels 14 being provided with cooperating keys 38 and keyways 24, the block units 18 can be quickly and easily assembled in the field at the site where the retaining wall 10 is to be erected. Preferably, the retaining wall 10 is built in offset rows 44 with each row being set back from the row below it. Referring to FIG. 1, the retaining walls 10 can be built by pouring a compacted road mix 45 on the surface on which the wall 10 is to be built. Thereafter, a bottom row 44 of masonry blocks 12 can be laid in side-by-side relation to one another on the road mix and, if soil 47 is being retained, preferably spaced forwardly from such soil by stones 49 between the wall and soil and having a 4'-diameter drain tile 51 placed near ground level for moisture run-off, as previously described. Next, successive rows 44 are laid in offset relation to each other as the rows progress upwardly such that each row is set back from the row below it, as best seen in FIG. 8. Further, the blocks in an upper row are placed on two adjoining blocks in a lower row so that the blocks 12 are in staggered relation to each other from one row to the next. Thus, the bottom edge 30 of the masonry blocks 12 rest on and are supported by a pair of adjacent lower row blocks, as best seen in FIG. 2.

In this manner, the entire retaining wall 10 initially can be built from the masonry blocks 12 with the decorative facing panels 14 being installed after the rows of masonry blocks 12 are set by sliding the keys 38 of the decorative facing panels 14 into the cooperating keyways 26 on their corresponding block bodies 16 such that the edge portion of the facing panels 14 at least partially rest on the masonry block bodies 16 therebelow to prevent the panel from sliding out of the keyway 26 of its corresponding block body. With the keyway interlock system 20, the panels can be easily removed and replaced if they are damaged or if changes in design are desired. It is also possible to permanently affix the decorative facing panels when the retaining wall 10 is being built, or at a later date if so desired, by applying an adhesive 53 to the front face 22 of the block body 16 as illustrated in FIGS. 3 and 21. The assignee of applicants herein has an adhesive product, SB-10 Paver Bond Adhesive, that is suitable for application to the masonry blocks 12 which cures and bonds the facing panels 14 thereto. As a safety measure, it may be desirable to use the SB-10 Adhesive between the top two layers of blocks and the top layer and any capping stone 55 used thereon, regardless of wall height. The adhesive made applied along the crack or top interface edge between the facing panel 14 and its associated masonry block to keep out water or moisture that could freeze and expand at the crack and break the block material.

The block bodies 16 may be cast in a wide variety of shapes. In one form, the block bodies 16 have a bottle-like shape, as illustrated in FIGS. 17 and 18. In a preferred form, the block bodies 16 are molded in an H-shape, as best seen in FIGS. 2–4, 6, 9, 16 and 19. Referring more specifically to FIGS. 2–4, the H-shaped block body 16 is defined by a pair of spaced legs 46 and 48 and a web 50 extending between the legs 46 and 48 intermediate thereof to form the H-shape for the block bodies 16.

To ensure a uniform set back from one row 44 to the next, the block bodies 16 can have a tab 52 projecting downwardly from the bottom 54 thereof, shown in FIGS. 5–8. The tab 52 fits into openings formed between adjacent blocks in the row therebelow such that the upper row block 16 can only be positioned forwardly to a point where its bottom edge 30 will be set back a predetermined distance from the top edge 28 of the blocks upon which it rests.

More specifically and referring to the H-shape blocks, the H-shaped blocks are placed in rows with corresponding ends 56 and 58 of each of the block legs 46 and 48 of adjacent blocks 12, respectively, abutting each other. In this manner, a pair of abutting masonry blocks 12 in a row 44 will form an opening 60 therebetween defined by the portions of the legs 46 and 48 extending from the web 50 towards the adjacent block 12, the adjacent block's corresponding leg portions 46 and 48 and the webs 50 of the two abutting blocks, as best seen in FIG. 2. The tab 52, as illustrated in FIGS. 5–8, has a substantially square cross-sectional shape and can be cast integrally with the block body 16 to project from the block bottom 54 under a portion of the web 50 and the forward leg 46. The tab 52 has a width corresponding to the width of the web 50 and has a length extending along the web 50 and the forward leg 46 corresponding to the length of the opening 60 between the two legs 46 and 48 such that the tabs 52 tightly fit lengthwise in the openings 60. With the tabs 52 inserted into the openings 60, blocks 12 in adjacent upper and lower rows are substantially fixed in a uniform off set relation to each other. Similarly, the tab 52 prevents the blocks 12 from being perfectly vertically aligned one on top of the other as the blocks must be vertically staggered by at least the width of the tab 52, and accordingly the web 50.

Figure 9:
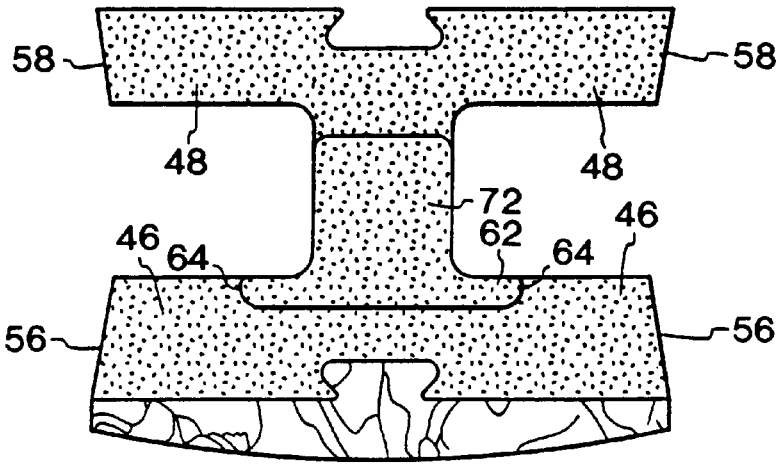
FIG. 9 is a bottom-plan view of the block of FIG. 3 having a modified T-shaped tab.
Figure 10:
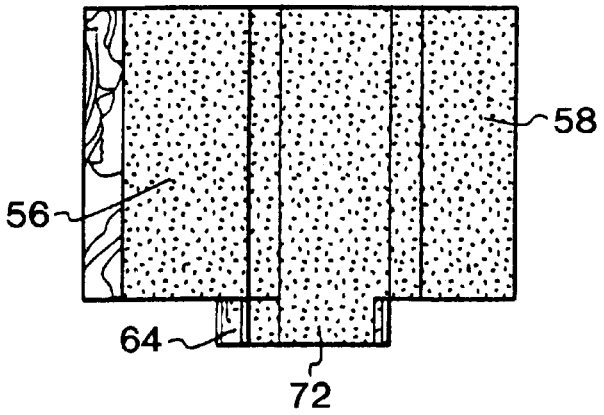
FIG. 10 is a side elevational view of the block and panel of FIG. 9.
Figure 11:
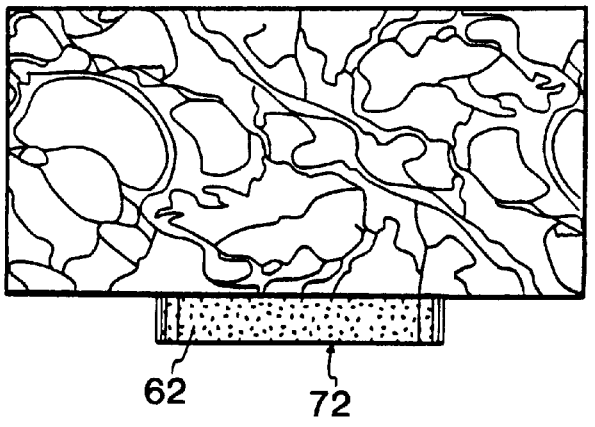
FIG. 11 is a front elevational view of the block and panel of FIG. 9.
Figure 12:
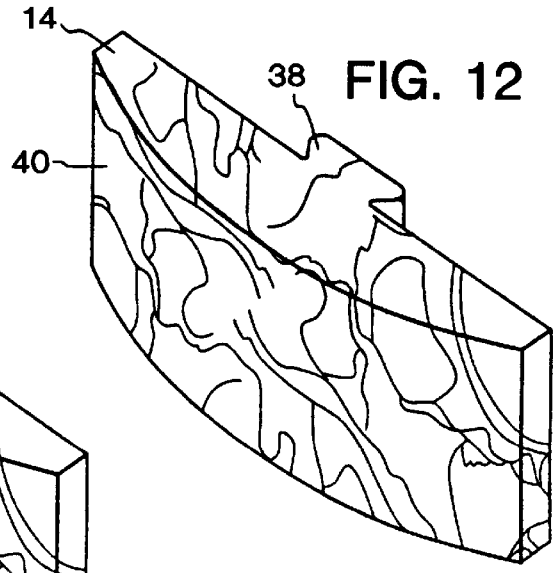
FIG. 12 is a perspective view of a first alternate embodiment of the decorative facing panel according to the present invention.

In an alternative embodiment the tab has a T-shape in cross-section, as illustrated in FIGS. 9–11. The T-shaped locating tab 72 is similar to the tab 52 depicted in FIGS. 5–8, with the exception of the forward portion 62 under the forward leg 46 which is elongated to form the crossbar of the T. The elongated forward tab portion 62 provides a greater surface area for contacting the forward legs 46 of the lower blocks 12 when the tab 72 is inserted in the opening 60 between the lower blocks. In addition, the elongated tab portion 62 ensures a greater stagger between blocks in successive rows than the square shaped tab 52 depicted in FIGS. 5–8 because the forward elongated portion 62 gives the T-shaped tab 72 a greater effective width versus the square-shaped tab 52 with the ends 64 of the elongate tab portion 62 preventing the upper blocks 12 from being moved into vertical alignment over blocks in the row therebelow. With blocks utilizing either tabs 52 or 72, the bottom row of such blocks can be placed on the compacted road mix 45 when forming the retaining walls 10 so the tabs 52 or 72 will extend upward into holes 60 formed between abutting blocks in the row thereabove.

In the embodiments shown in FIGS. 22–25, a lighter weight and less expensive retaining wall 10*a* may be provided with retaining wall blocks 12*a* made of plastic and assembled as above-described and with discrete and separate, decorative facing panels 14*a* selected from a decorative material selected from stone, marble, granite, glass, tile or metal attached to the faces of the plastic blocks. The illustrated blocks are made of plastic such as a molded polyolefin material including polypropylene and polyethylene or a molded ABS material. Filler materials or strengthening members of other materials may be added to lower the cost and/or improve the strength of the blocks. The plastic blocks 12*a* with their decorative facing panels are expected to be used, primarily by homeowners or other non-professionals, and purchased at retail hardware stores, landscape nurseries, etc. and are intended to be a lightweight and lower cost alternative to the heavier and more expensive masonry retaining wall 10 described in connection with FIGS. 1–21. The masonry blocks typically weigh 60 to 80 lbs., while the illustrated, plastic blocks weigh about 12 to 16 pounds.

Figure 25:
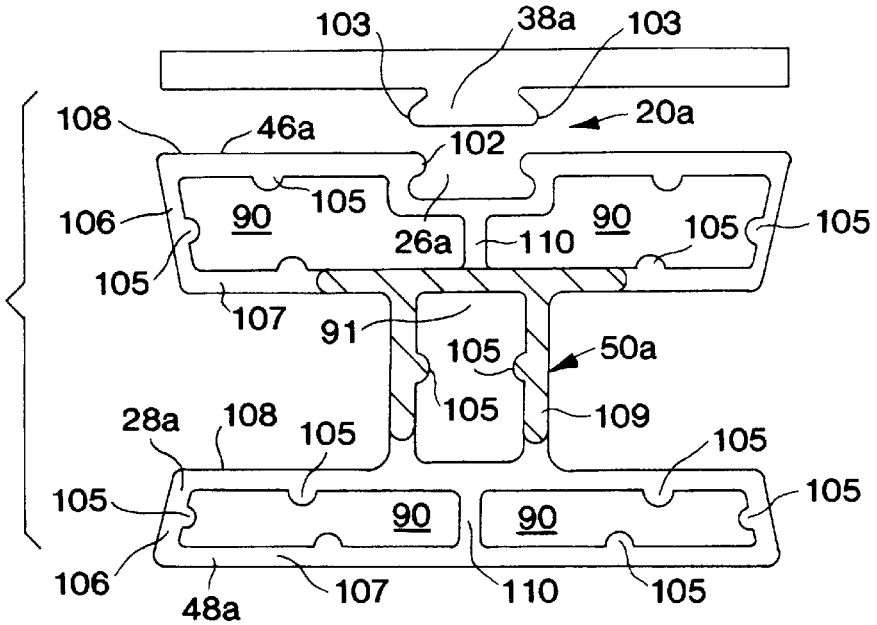
FIG. 25 is a plan view, partially sectioned, showing a plastic block and a decorative facing panel.

As best seen in FIGS. 25, the preferred plastic blocks 12*a* have hollow spaced 90 in a front leg 46*a* and in the rear leg 48*a,* which are open at the top and bottom edges or sides 28*a* and 30*a* of the block. These hollow spaces 90 in these legs as well as a hollow space 91 within the web 50*a* not only reduce the amount of plastic used to make the block and thereby reduce the cost of the block, but also provide closed, wall, hollow spaces to receive the heavy gravel or the like. That is, these hollow, closed wall spaces 90 in the plastic block 12*a* may be filled with materials such as coarse gravel or pea gravel to add weight and stability to the retaining wall after a block has been put in position on the wall, like the wall shown in FIG. 1. In the embodiment shown in FIG. 25, the top of block is open at the front legs and the bottom legs with the spaces 90 extending the full vertical height of the block. The top of the web 50*a* between the legs is covered by a T-shaped tab 72*a* or by a tab 52*a*. Because the blocks are so light, e.g., 12–16 lbs. vs. the 60–80 lbs. for masonry blocks, it is preferred that openings or hollows be formed in the blocks into which gravel may be added to fill the plastic blocks to aid in retention of the light, plastic blocks against sliding laterally over one another. The plastic interface between stacked plastic blocks is substantially less than the coefficient of friction between stacked masonry blocks. Thus, the tabs 52*a* and the gravel aid in preventing the lateral sliding of the blocks in one row relative to the blocks in another row thereabove or therebelow.

The plastic blocks 12*a* have rounded or radius corners 101 (FIGS. 22 and 23) thereon rather than sharp corners that were formed on the masonry blocks 12 described with respect to FIGS. 1–21. Also, as best seen in FIG. 25, the keyway interlock system 20*a,* which is formed of the key 38*a* and the keyway 26*a,* has rounded entrance corners 102 forming an entrance throat into the larger keyway space that receives the key 38*a.* Corners 103 of the key on the facing panel are preferably rounded or radiuses and fit into against concave, radiused slot walls at internal corners of the keyway. The rounded corners are preferred because they are easier to mold and will not break off, as could straight or sharp corners.

The preferred plastic block 12*a* has its front portion or leg 46*a,* its intermediate web 50*a,* and the rear leg or portion 48*a* formed with internal ribs 105 (FIG. 25) to add strength to the respective vertical, plastic walls 106, 107, 108 and 109 on the blocks. The illustrated hollow portions 90 have vertically extending ribs 105 that extend substantially the full height of their respective walls 106–109 and of the hollow, internal spaces enclosed on the four sides thereof by these vertical walls 106–109. Herein, at least one rib 105 is provided on each of the walls forming the hollow spaces. The ribs are preferably radiused, integral pieces of plastic that add substantial strength and rigidity to the block without adding substantially weight or cost of plastic material for the block. The preferred ribs 105 are only 0.125 inch thick.

Further, strength and rigidity is added to the plastic blocks by having a small web wall 110 extending between block sidewalls 107 and 108 at the central location of the block in alignment with the large, hollow web 50*a* joining the front and rear legs of the block together. Also, one of the web walls 110 is located behind the keyway 26*a* and adds strength and stability to the rear, vertical wall of the keyway. The web walls divide the internal spaces in two in the front and rear sidewalls 107 and 108 against bulging when filled with gravel and supporting the load of a stack of blocks thereabove.

Because the plastic blocks 12*a* are made of plastic, which has a low coefficient of friction, the stacked blocks will tend to slide relative to one another. This shifting and sliding is prevented herein by locating tabs which are similar to the locating tabs 52 or 72 described in connection with FIGS. 1–21; except that the tabs in FIGS. 22–25 are formed of plastic. The tabs 52*a* (FIGS. 24–24) are integrally molded on the block, top surfaces 28*a* over the intermediate web 50*a*. A receiving opening 60*a* (FIG. 23) is formed in the bottom of the block to receive the tab 52*a* in the same manner as described for the masonry blocks of FIGS. 1–23.

The facing panels 14*a* may be substantially identical to and made of the same material as the facing panels 14 described in connection with FIGS. 1–21. Often, the facing panels may be made of a stone or brick like material to give a decorative garden or landscaping wall used in connection with the landscape of plants and shrubs about a home or commercial building. The facing panels 14*a* are preferably added after the retaining wall blocks have been laid to form a wall so as not to deface the outer surface of the decorative front face 40*a* of the panel 14*a* when building the retaining wall of the plastic blocks. The facing panels are slid down along the front faces 22*a* of the plastic blocks to interlock the dovetail-shaped, keylock interconnection system 20*a;* and rear faces 24*a* on the facing panels are preferably bonded by adhesive 53*a* along their rear faces to the front faces of the plastic blocks by the adhesive therebetween.

Figure 22:
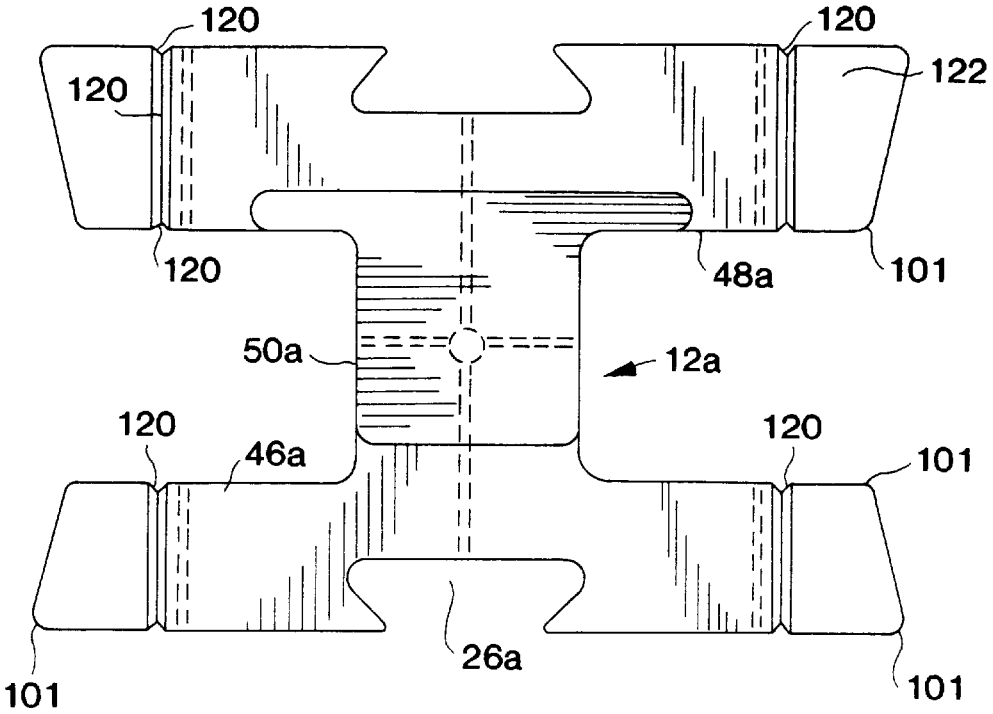
FIG. 22 is a plan view of a plastic, retaining block according to a preferred embodiment of the invention.
Figure 23:
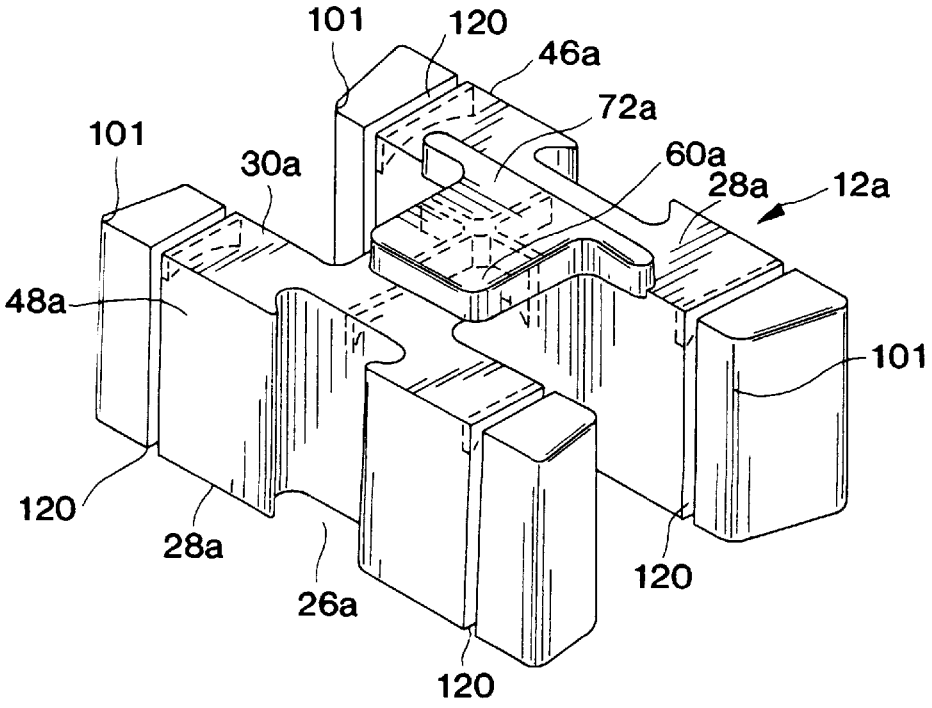
FIG. 23 is a perspective view of the plastic block of FIG. 22.
Figure 24:
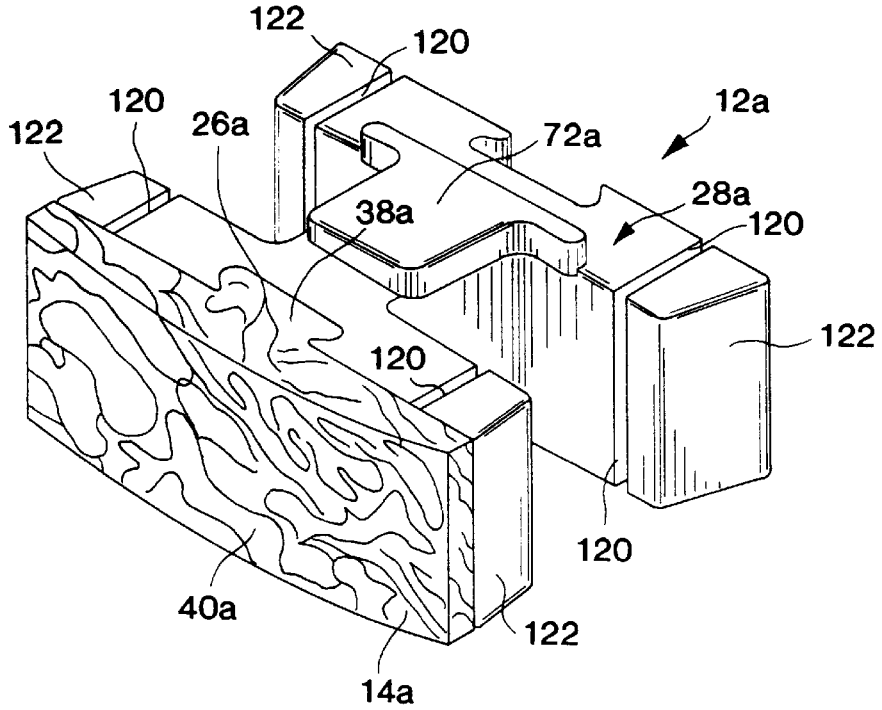
FIG. 24 is a perspective view of the plastic block with an attached, decorative, facing panel.

Preferably, as shown in FIGS. 22–24, the plastic blocks 12*a* may be shortened by cutting the blocks at "V"-grooves 120 in the four corners of the block. After cutting, the end pieces 122 may be bent and snapped off to form a shorter block. Typically, shorter blocks will be desired for forming a radiused, curved, corner wall.

It is expected that the purchaser and user will probably use the plastic retaining blocks 12*a* with the decorative facing panels 14*a* for lighter load and less height installations than the masonry blocks 12 described in connection with FIGS. 1–21.

While the invention has been described with regards to its preferred embodiments, which constitute the best modes known to the inventor, it should be understood that various changes and modifications may be made without departing from the scope and spirit of the invention which is intended to be set forth in the claims appended hereto.

What is claimed is:

1. An outside plastic retaining wall for retaining earth and made with an outer decorative surface other than the plastic of the wall, comprising:

a plurality of rows of plastic blocks for retaining the earth and with the blocks each including a top edge and a bottom edge and a front face being made from a plastic material and having a plastic appearance extending between the top edge and the bottom edge, the blocks in an upper row being stacked upon the blocks in an adjacent lower row below the upper row with the bottom edges of the upper row blocks supported on adjacent lower row blocks;

the plastic blocks each having a unitary body formed with an integral front portion having the front face for facing outwardly toward the front of the retaining wall and having an exposed plastic surface;

the adjacent front portions of adjacent plastic blocks forming the front of the retaining wall;

a rearwardly extending web portion integrally joined to the integral front portion each of the unitary plastic blocks and extending rearwardly therefrom;

a rear leg portion integrally joined to the web portion and being spaced from the front portion by hollow spaces in each plastic block;

discrete and separate decorative facing panels substantially smaller in size than the plastic blocks and made of a decorative material selected from stone, marble, granite, glass, tile or metal and having rear faces attached to the front faces of the plastic blocks to cover the exposed plastic surfaces of the front faces of the plastic blocks and to change the outward appearance of the front faces of the plastic blocks;

the decorative facing panels being made of different material than the plastic block material;

the decorative panels being substantially thinner in thickness than the blocks forming the retaining wall; and a keyway and key connection being formed in each of the front faces of the blocks and rear faces of the decorative facing panels, respectively for mounting the decorative facing panels flush against the front faces of the blocks to cover the plastic front faces of the plastic blocks to provide the outer decorative surface for the retaining wall.

2. The retaining wall of claim 1 wherein the keyway comprises a vertical keyway extending between the top and bottom edges of each of the blocks.

3. The retaining wall of claim 1 wherein the blocks have hollow, vertical spaces, and gravel is disposed in said hollow spaces.

4. The retaining wall of claim 1 wherein the blocks each have a back face and a keyway is formed in the back faces of the blocks for mounting facing panels flush against the back faces of the blocks.

5. The retaining wall of claim 1 wherein the blocks each include a top and a bottom with the bottom of the blocks having tabs protruding therefrom and the blocks being configured to form openings between adjacent blocks in a row such that with the tabs of the upper blocks inserted in the openings between corresponding lower blocks the tabs and openings cooperate to substantially fix the stacked blocks in adjacent upper and lower rows in offset relation to each other.

6. The retaining wall of claim 1 wherein the blocks are made from a plastic material having a filler material therein.

7. The retaining wall of claim 1 wherein the facing panels have tongue keys which are sized to fit into the keyways on the blocks; and an adhesive is applied between the facing panels and the front faces of the blocks to secure the panels to their corresponding blocks.

8. A method for forming a plastic retaining wall for retaining earth and having an outer decorative surface providing an appearance of being other than being made of plastic material, the method comprising the steps of:

providing a plurality of plastic blocks made of plastic material having keyways with a first cross-sectional shape formed in their faces;

providing plastic blocks having a unitary body formed with an integral front portion having the front face;

the adjacent front portions of adjacent plastic blocks forming the front of the retaining wall, a rearwardly extending web portion integrally joined to the integral front portion of the unitary plastic blocks and extending rearwardly therefrom, a rear leg portion integrally joined to the web portion and being spaced from the front portion by hollow spaces in each of the plastic block;

providing a plurality of decorative facing panels having elongate locating members with a second cross-sectional shape substantially the same as the first cross-sectional shape of the keyways, the decorative facing panels being made of different material than the plastic block material and made of a decorative material, the decorative panels being substantially thinner in thickness than the front block portions forming the outer sides of the retaining wall;

stacking the blocks in rows with each row being set upon the row below it to form a wall having a front side outwardly exposed, front side, plastic surfaces with offsetting the plastic blocks in rows with each row offset from the row below it to engage and support a portion of a decorative panel on a plastic block thereabove;

after forming the plastic retaining wall, covering the outwardly exposed, front side, plastic surfaces of the plastic blocks by attaching the decorative facing panels to the blocks by sliding the locating members of the facing panels down into the keyways of the blocks; and resting portions of the lower edge of the decorative facing panel on portions of the offset block below it with the decorative panels flush against the front faces of the blocks to which they are attached to provide the previously formed plastic wall with the outer appearance of the decorative material of the decorative panels.

9. The method of claim 8 wherein the step of attaching the decorative facing panels further includes the step of applying adhesive to the blocks to fix the decorative facing panels to the blocks.

10. The method of claim 8 wherein the blocks are provided with tabs and including the step of stacking the blocks in offset rows by inserting the tabs in openings formed between adjacent blocks immediately therebelow to produce a uniform set back from one row to the next.

11. The method of claim 8 wherein the decorative facing panels are formed of a metallic material.

12. A decorative retaining wall block comprising:

a body made of a plastic material having the appearance of a plastic product on a front face of the block;

a first portion of a keyway interlock on the front face of the plastic body adjacent the front exterior side of the block;

a discrete and separate, decorative, facing panel substantially smaller in size than the plastic body and made of a decorative material selected from stone, marble, granite, glass, tile or metal and attached to the front face of the plastic product to cover the exposed plastic surface of the front face of the plastic body to change the outward face appearance of the block;

a second portion of the keyway interlock on the decorative facing panel to interlock the decorative facing panel to the plastic body;

the plastic block having a unitary body formed with an integral front portion having the front face for facing outwardly to the front of the retaining wall and having an exposed plastic surface until covered by the decorative facing panel;

a rearwardly extending web portion integrally joined to the integral front portion;

a rear leg portion integrally joined to the web portion and being spaced from the front portion by hollow spaces in the plastic block;

the decorative facing panel being made of different material than the plastic body material; and the decorative panels being substantially thinner in thickness than the block body forming the other sides of the retaining wall.

13. The decorative retaining wall block of claim 12 wherein the first portion comprises an elongated keyway having a first cross-sectional shape; and the second portion includes a tongue key having a second, cross-sectional shape substantially the same as the first, cross-sectional shape of the keyways.

14. The decorative retaining wall block of claim 13 wherein the keyways and keys have complementary trapezoidal, cross-sectional shapes.

15. The decorative retaining wall block of claim 12 wherein the block body has an H-shape in cross-section defined by a pair of spaced, elongated legs spanned by an intermediate web with the block face and interlocked first portion on at least one of the spaced legs.

16. A decorative retaining wall block comprising:

a body made of a plastic material having the appearance of a plastic product on a front face of the block;

a first portion of a keyway interlock on the front face of the plastic blocks;

a decorative facing panel substantially smaller in size than the plastic body attached to the front face of the plastic product to change the outward face appearance of the block;

a second portion of the keyway interlock on the decorative facing panel to interlock the decorative facing panel to the plastic body; and the block body having an H-shape in cross-section defined by a pair of spaced elongate legs spanned by an intermediate web with the block face and interlock first portion on at least one of the spaced legs, the web and one of the legs including a tab protruding from the bottom thereof which fits in openings formed between blocks immediately therebelow with the ends of said legs abutting each other such that with blocks stacked in rows the tabs uniformly set back the blocks in one row from the row therebelow.

* * * * *